US008955686B2

(12) United States Patent
Rhodes et al.

(10) Patent No.: US 8,955,686 B2
(45) Date of Patent: Feb. 17, 2015

(54) MAGNETIC SEPARATOR SYSTEM

(71) Applicant: Magnetic Products, Inc., Highland, MI (US)

(72) Inventors: Keith Rhodes, Highland, MI (US); Ronald Kwasniewicz, Walled Lake, MI (US)

(73) Assignee: Magnetic Products, Inc., Highland, MI (US)

( * ) Notice: Subject to any disclaimer, the term of this patent is extended or adjusted under 35 U.S.C. 154(b) by 61 days.

(21) Appl. No.: 13/938,881

(22) Filed: Jul. 10, 2013

(65) Prior Publication Data

US 2014/0014560 A1 Jan. 16, 2014

Related U.S. Application Data

(60) Provisional application No. 61/670,174, filed on Jul. 11, 2012.

(51) Int. Cl.

| | |
|---|---|
| ***B03C 1/16*** | (2006.01) |
| ***B03C 1/18*** | (2006.01) |
| ***B03C 1/02*** | (2006.01) |

(52) U.S. Cl.

CPC ... *B03C 1/02* (2013.01); *B03C 1/16* (2013.01); *B03C 1/18* (2013.01); *B03C 2201/20* (2013.01)

USPC ..... 209/217; 209/223.1; 209/225; 209/226

(58) Field of Classification Search

USPC ..... 209/217–221, 225, 229, 226, 227, 920, 209/198; 198/690.1

See application file for complete search history.

(56) References Cited

U.S. PATENT DOCUMENTS

| | | | | |
|---|---|---|---|---|
| 3,712,472 | A | 1/1973 | Elliott | |
| 4,125,191 | A * | 11/1978 | Peace | 209/636 |
| 4,394,264 | A | 7/1983 | Schimion et al. | |
| 4,457,838 | A | 7/1984 | Carr | |
| 4,686,034 | A * | 8/1987 | Barrett | 209/223.1 |
| 4,867,869 | A | 9/1989 | Barrett | |
| 5,043,063 | A | 8/1991 | Latimer | |
| 5,066,390 | A | 11/1991 | Rhodes et al. | |
| 5,188,239 | A | 2/1993 | Stowe | |
| 5,190,159 | A | 3/1993 | Barker | |
| 5,982,261 | A | 11/1999 | Stowe | |
| 6,077,333 | A | 6/2000 | Wolfs | |
| 6,099,739 | A | 8/2000 | Kobayashi | |
| 6,250,475 | B1 | 6/2001 | Kwasniewicz et al. | |
| 7,210,581 | B2 * | 5/2007 | Robinson et al. | 209/221 |
| 2005/0189264 | A1 * | 9/2005 | Wise | 209/225 |
| 2006/0231467 | A1 * | 10/2006 | Wise | 209/225 |
| 2006/0254960 | A1 * | 11/2006 | Wise | 209/215 |
| 2006/0260984 | A1 * | 11/2006 | Wise | 209/225 |
| 2006/0260985 | A1 * | 11/2006 | Wise | 209/225 |
| 2006/0260986 | A1 * | 11/2006 | Wise | 209/225 |

* cited by examiner

*Primary Examiner* — Patrick Cicchino

(74) *Attorney, Agent, or Firm* — Howard & Howard Attorneys PLLC

(57) ABSTRACT

A magnetic separator system includes a lower conveyor adapted to convey comingled materials to be separated and an upper conveyor disposed above the lower conveyor. The magnetic separator system also includes at least one magnet extending along a length of the upper conveyor to transfer metallic materials from the comingled materials to the upper conveyor. The magnetic separator system further includes an oscillator for moving along the at least one magnet in a reversing motion across a width of the upper conveyor causing the metallic materials to flip over and over and enabling non-metallic materials entrapped with the metallic materials to become separated from the metallic materials and fall to the lower conveyor.

20 Claims, 8 Drawing Sheets

MAGNETIC SEPARATOR SYSTEM

CROSS-REFERENCE TO RELATED APPLICATION(S)

The present application claims the priority date of U.S. Provisional Patent Application Ser. No. 61/670,174, filed Jul. 11, 2012.

BACKGROUND OF THE INVENTION

1. Field of the Invention

The present invention relates generally to magnetic separators for separating metallic materials from a product stream and, more particularly, to a magnetic separator system for separating metallic materials from non-metallic materials in a product stream.

2. Description of the Related Art

Municipal Solid Waste (MSW) is processed today in various ways to extract valued materials for recycling, conversion to fuel to generate energy, and reduce the amount of materials going to landfill sites. The facilities conducting these processes are known as Material Recycling Facilities or MRFs. A growing practice within the MRF industry is to process MSW in what is called a "single stream" manner. In other words, all materials arrive to the MRF in a single stream as opposed to being pre-sorted curbside by material types such as glass, metals, plastics, etc.

Currently, the conventional method for creating this separation is done in a variety of ways including, but not limited to, magnetic separators, eddy current separators, and mechanical screeners. The current magnetic separation technology results in many of the non-metallic materials becoming entrapped with the metallic materials as the magnet captures and removes the metallic materials from the product stream. This results in only a partial separation that severely limits the value of the captured metallic materials and reduces the amount of non-metallic materials being recovered from the product stream. Moreover, the non-metallic materials typically possess a combustive quality that is reconfigured into a fuel source to produce energy to be used in a power generation plant.

Currently, recyclers typically process materials through a number of magnetic separators installed in sequence. As the materials pass through each magnet, the entrapped materials as a total percentage of the volume being magnetically separated is reduced. Depending on how "clean" the metallic materials need to be before they are deemed acceptable for recycling to the processor and/or depending on how much of the non-metallic materials need to be recovered for conversion to energy typically dictates how many magnets are used in the process. This can result in significant capital investment for magnetic equipment, a much larger footprint requirement for the process, and increased ongoing system maintenance costs of multiple magnetic equipment devices.

Therefore, it is desirable to provide a system that employs a single device to effectively capture only the metallic materials in a production processing environment without retaining entrapping non-metallic materials. It is also desirable to provide a system that captures metallic materials for recycling without the need for additional magnetic equipment in sequence or other secondary processing. Thus, there is a need in the art to provide a magnetic separator system that meets at least one of these desires.

SUMMARY OF THE INVENTION

It is, therefore, one object of the present invention to provide a magnetic separator system for effectively capturing metallic materials.

It is another object of the present invention to provide a magnetic separator system having improved separation of metallic materials from non-metallic materials in a product stream.

To achieve one or more of the foregoing objects, the present invention is a magnetic separator system including a lower conveyor adapted to convey comingled materials to be separated and an upper conveyor disposed above the lower conveyor. The magnetic separator system also includes at least one magnet extending along a length of the upper conveyor to transfer metallic materials from the comingled materials to the upper conveyor. The magnetic separator system further includes an oscillator for moving along the at least one magnet in a reversing motion across a width of the upper conveyor causing the metallic materials to flip over and over and enabling non-metallic materials entrapped with the metallic materials to become separated from the metallic materials and fall to the lower conveyor.

According to one aspect of the present invention, by the time the metallic materials reach the end of the upper conveyor, only magnetic metallic materials remain on the upper conveyor. The upper conveyor is extended beyond a discharge point of the lower conveyor so that when the metallic materials reach the end of the upper conveyor and are discharged by gravity, they fall into a separate collection area for further processing.

One advantage of the present invention is that a new magnetic separator system is provided for effectively capturing only the metallic materials in a production processing environment without entrapping the non-metallic materials. Another advantage of the present invention is that the magnetic separator system results in greater value of the captured metallic materials for recycling without the need for additional magnetic equipment in sequence or other secondary processing. Yet another advantage of the present invention is that the magnetic separator system provides for moving of the magnets to remove non-metallic materials, thereby allowing more of these non-metallic materials to be converted to energy and adding value to the tons per hour (TPH) return on investment (ROI) of the materials being processed.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
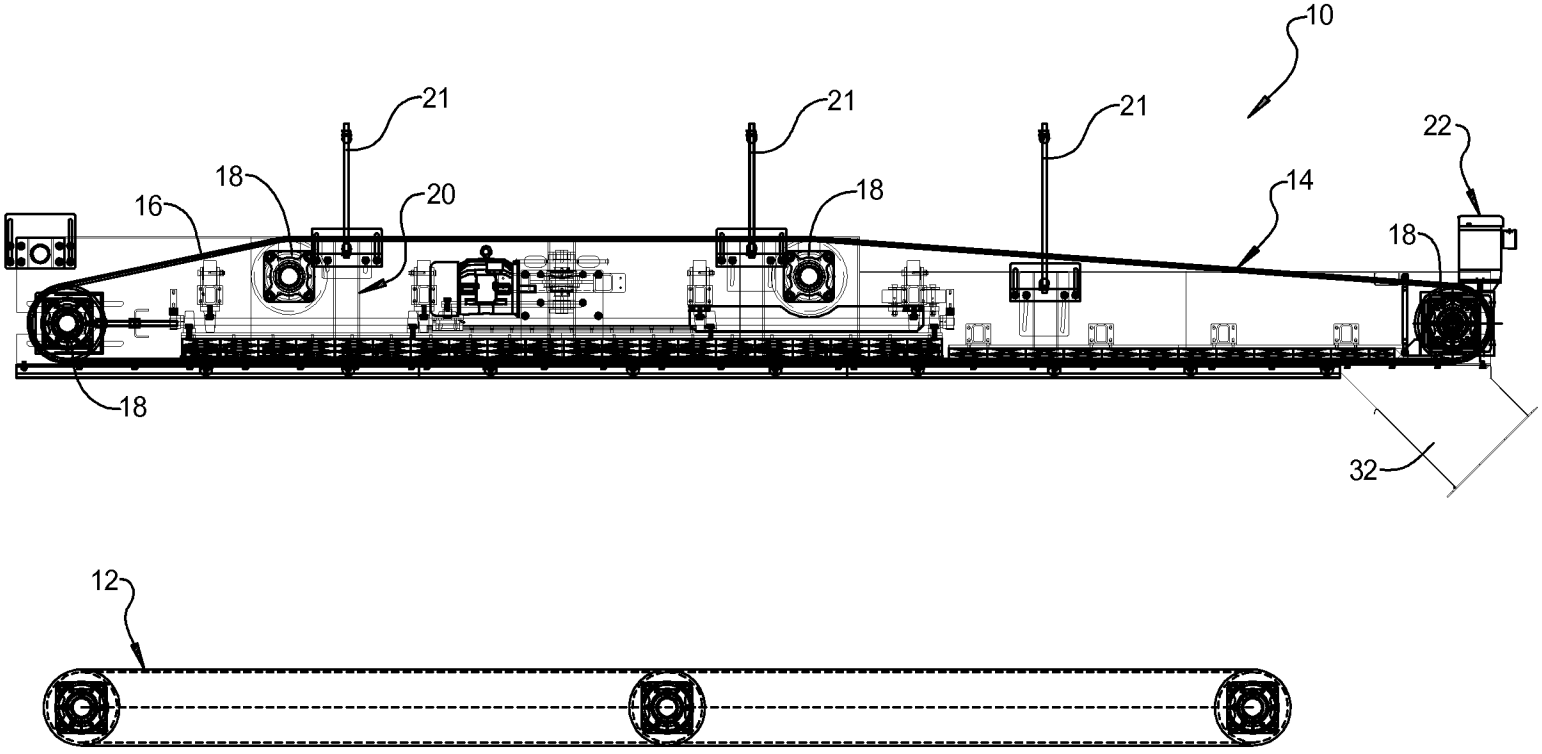
FIG. 1 is a front elevational view of a magnetic separator system, according to the present invention.
Figure 2:
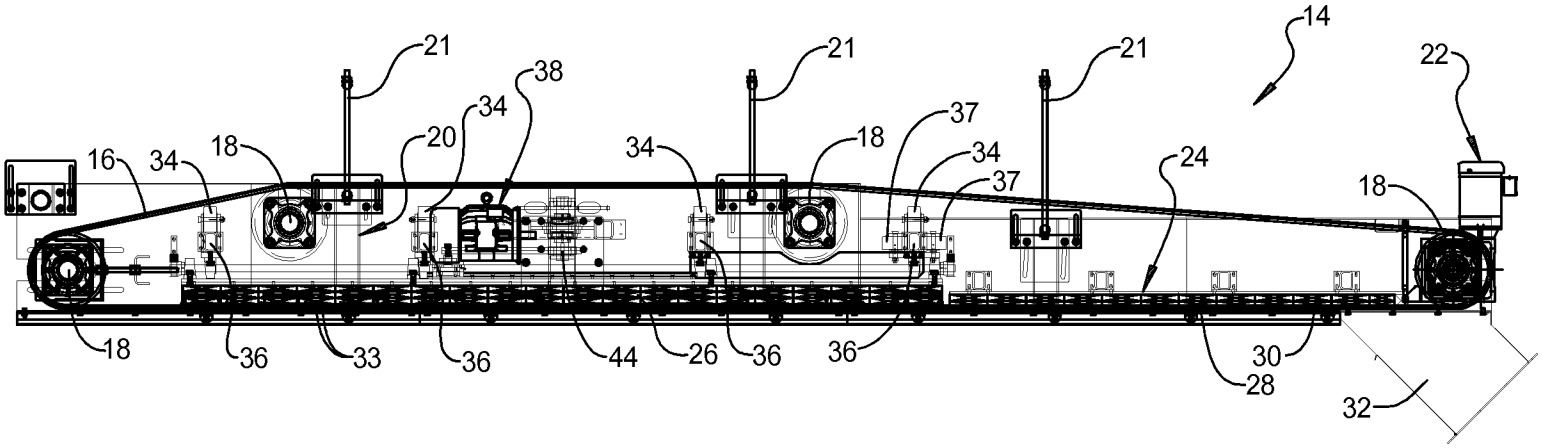
FIG. 2 is an enlarged front elevational view of a portion of the magnetic separator system, according to the present invention.
Figure 3A:
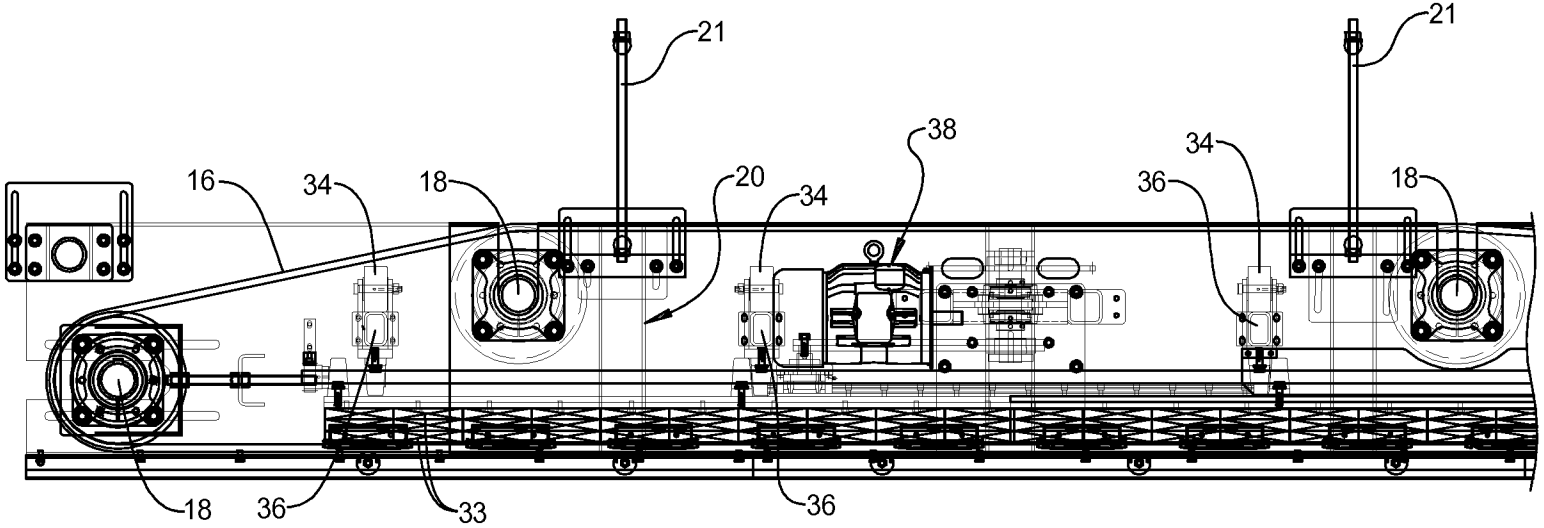
FIGS. 3A and 3B are enlarged front elevational views of FIG. 2.
Figure 3B:
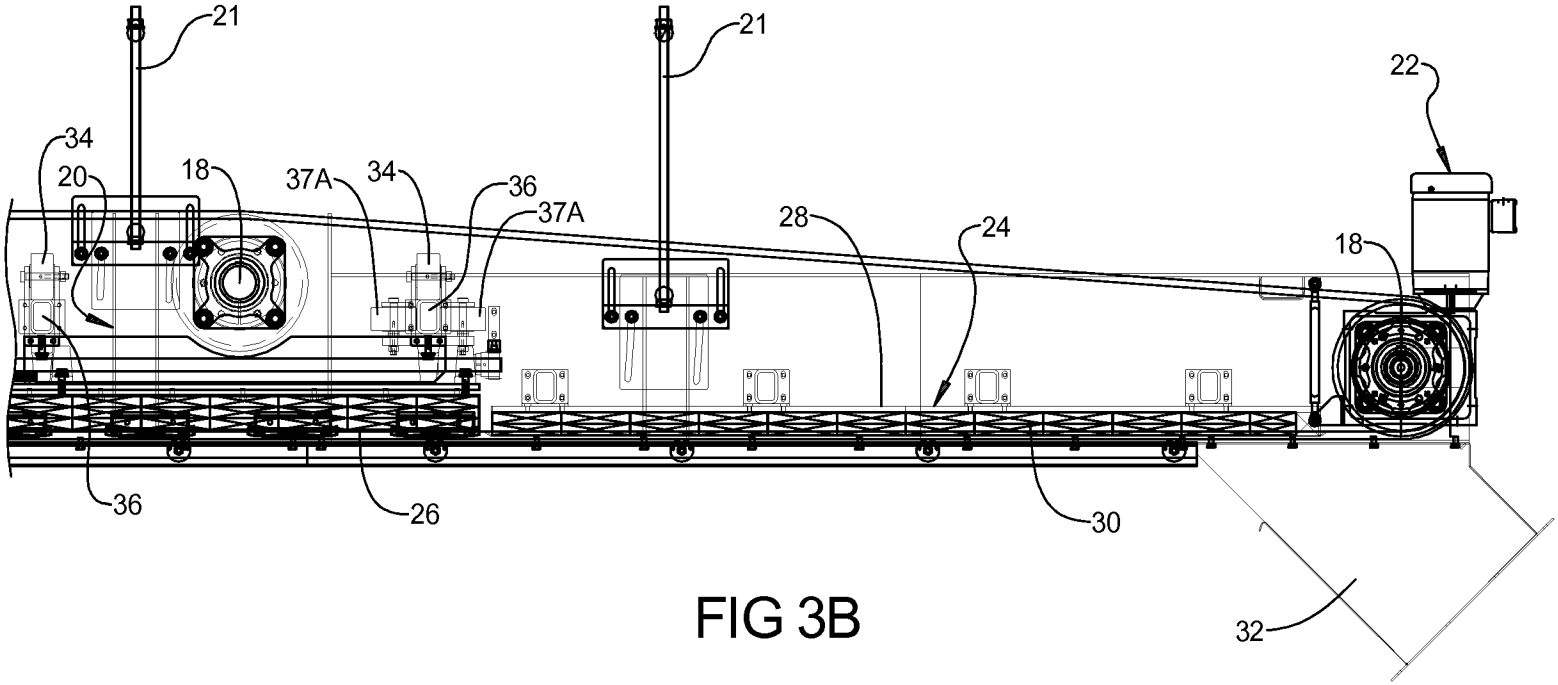
Figure 4:
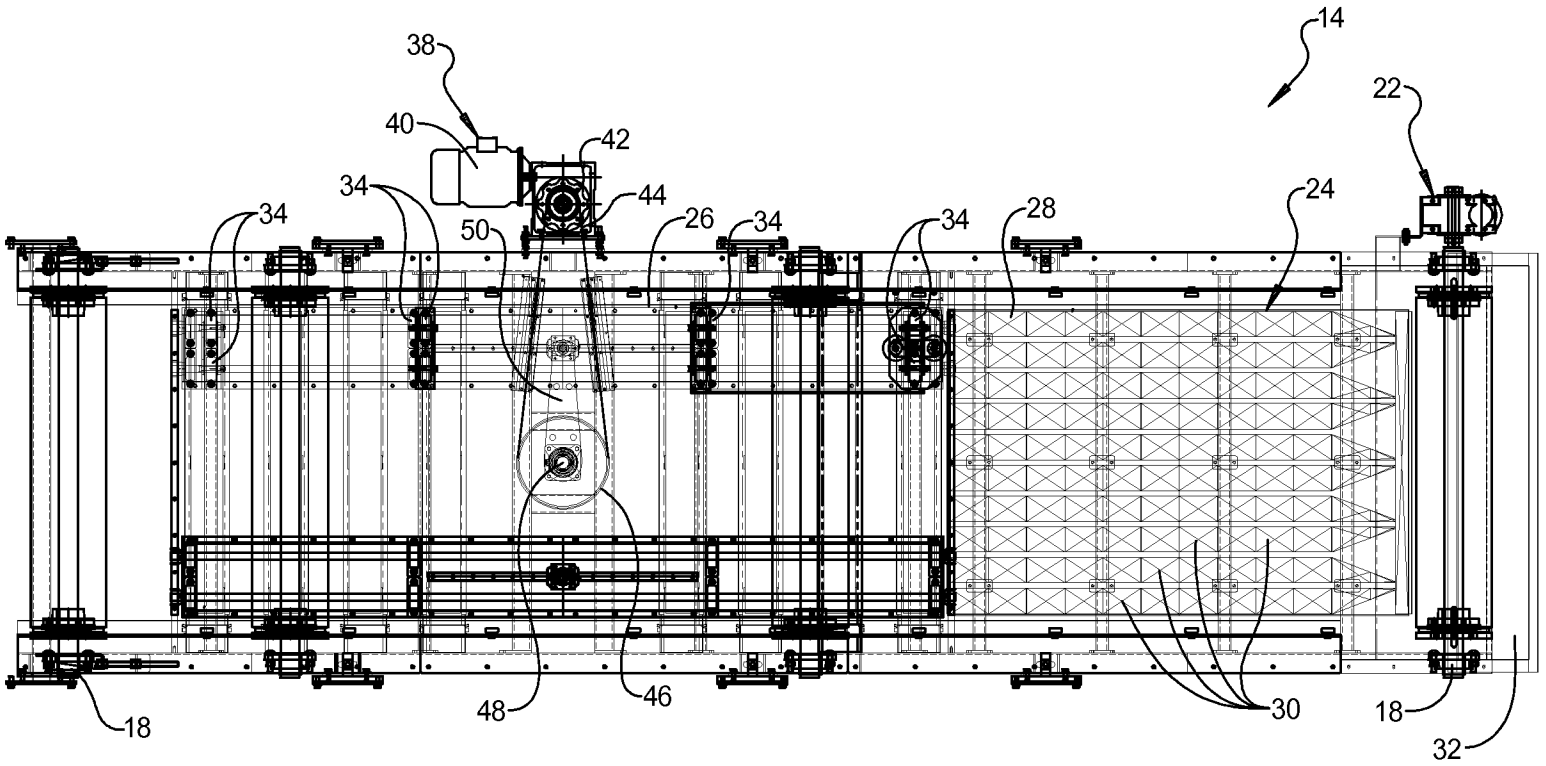
FIG. 4 is a plan view of the portion of the magnetic separator system, according to the present invention.
Figure 5A:
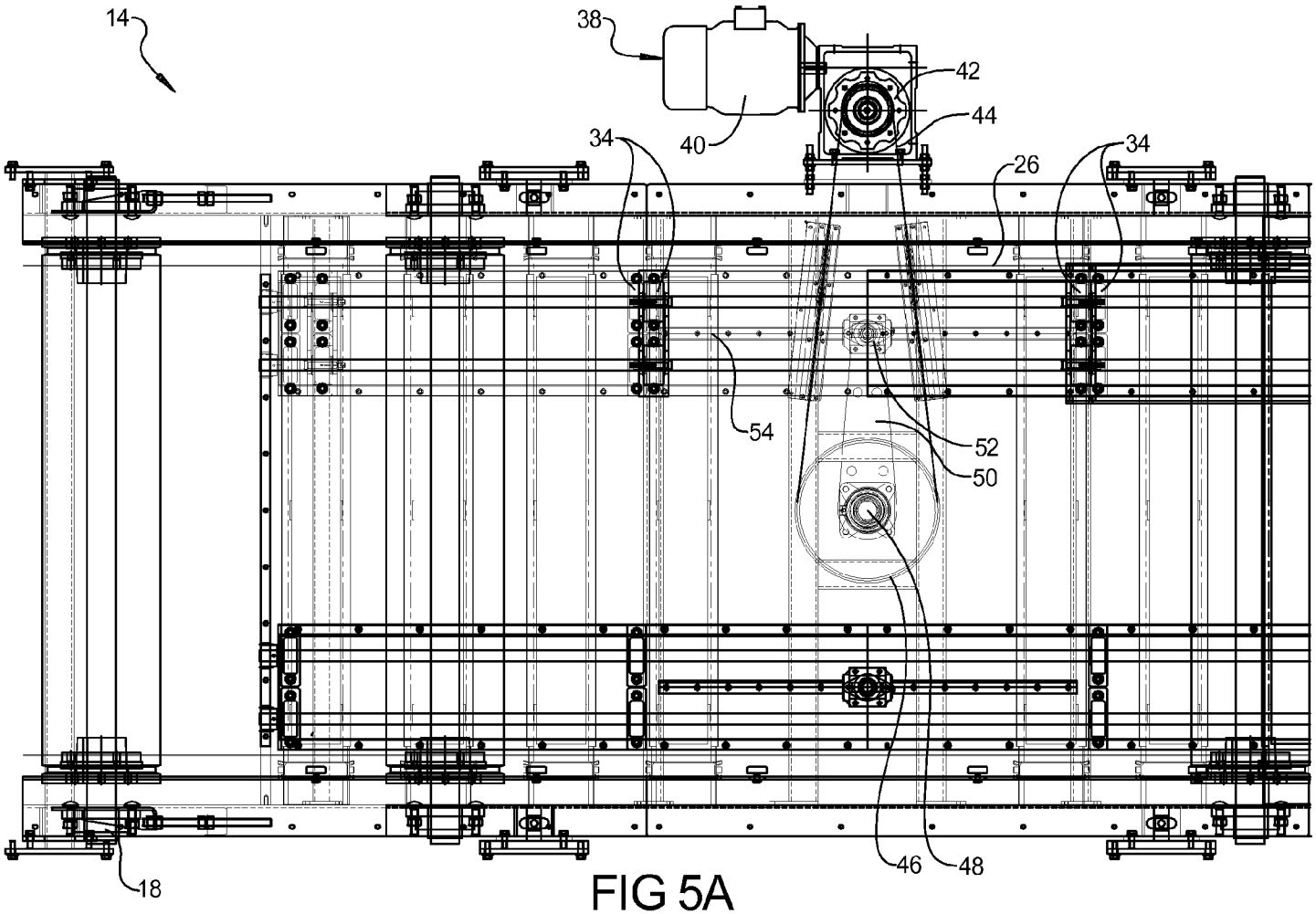
FIGS. 5A and 5B are enlarged plan views of FIG. 4.
Figure 5B:
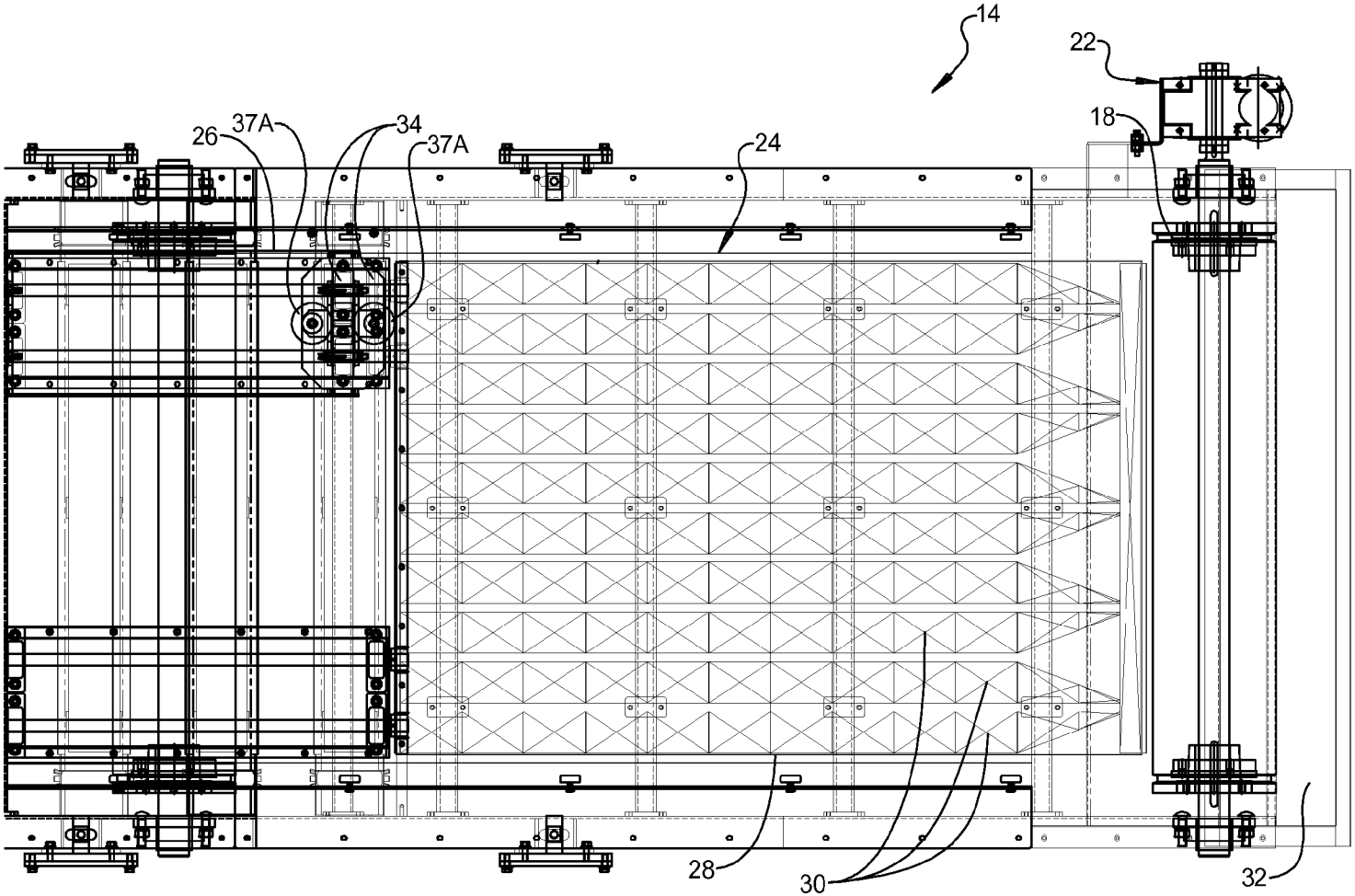
Figure 6:
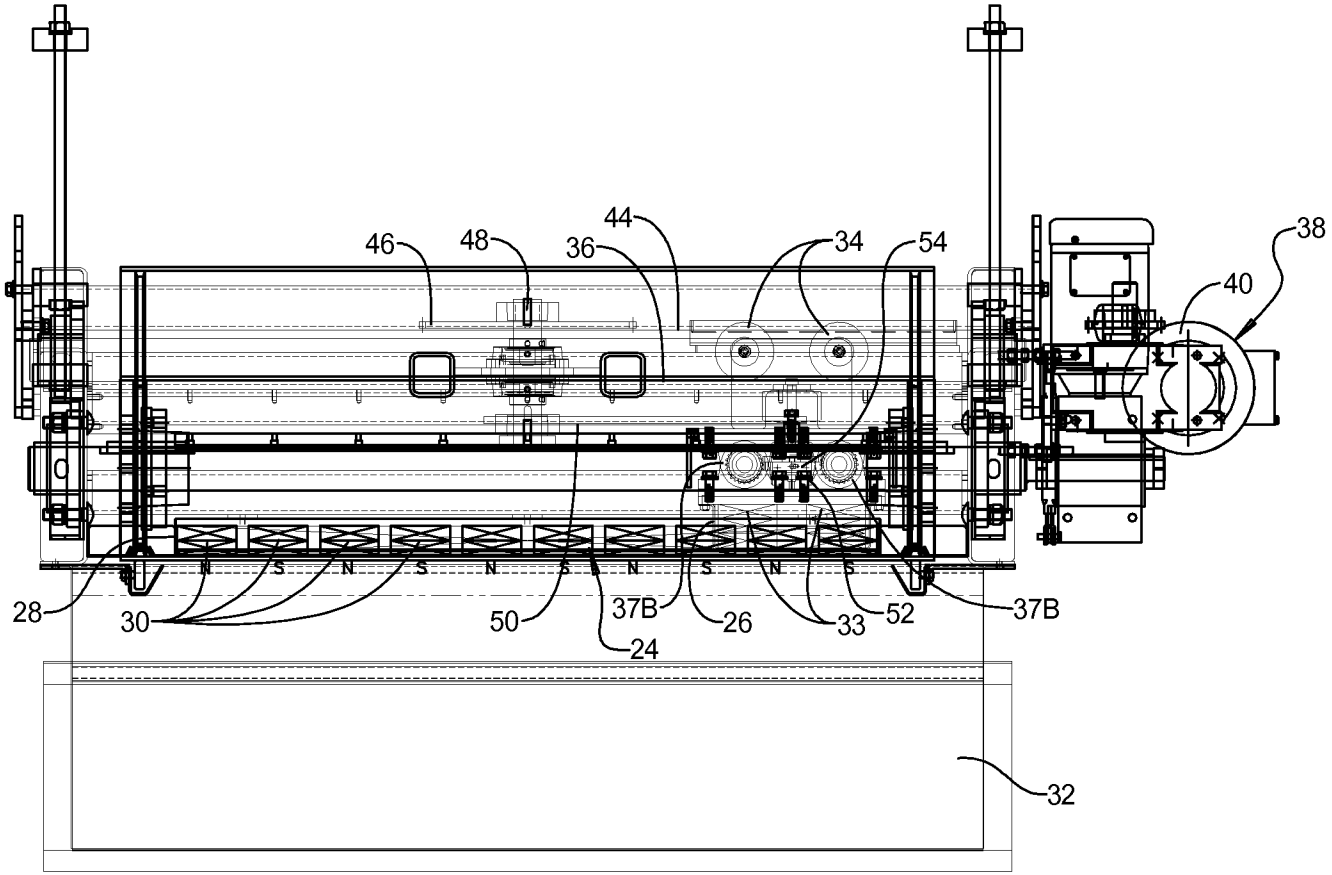
FIG. 6 is a side elevational view of the portion of the magnetic separator system, according to the present invention.

Referring now to the drawings, and in particular FIG. 1, one embodiment of a magnetic separator system 10, according to the present invention, is shown for separating metallic materials from non-metallic materials. In one application, the magnetic separator system 10 is used for processing MSW materials. The magnetic separator system 10 may be used in many other recycling applications such as tire/rubber, plastics, electronics, construction and demolition (C&D), or other wood products to name a few. It should be appreciated that the magnetic separator system 10 may be used in an application for any material that has metallic materials comingled with non-metallic materials which when separated has a greater value.

As illustrated in FIG. 1, the magnetic separator system 10 includes a lower conveyor, generally indicated at 12, adapted to convey comingled materials to be separated. In one embodiment, the lower conveyor 12 is a belt conveyor. In another embodiment, the lower conveyor 12 is a vibratory conveyor. It should be appreciated that the lower conveyor 12 is conventional and known in the art.

The magnetic separator system 10 also includes an upper conveyor, generally indicated at 14, located or disposed above and in close proximity to the lower conveyor 12. In one embodiment, the upper conveyor 14 is a belt conveyor. The upper conveyor 14 includes a conveyor belt 16 disposed over a plurality of rotatable rollers 18 rotatably connected to a frame, generally indicated at 20. The frame 20 is suspended by a series of hangers 21 over the lower conveyor 12. It should be appreciated that the frame 20 has suitable support members for the conveyor belt 16, rollers 18, and hangers 21.

Referring to FIGS. 2 through 6, the upper conveyor 14 also includes a belt drive system, generally indicated at 22, connected to the frame 20 and to one of the rollers 18 for rotation thereof. In the embodiment illustrated, the belt drive system 22 is connected to the roller 18 adjacent the discharge end of the upper conveyor 14. It should be appreciated that the belt drive system 22 rotates the roller 18 to move the conveyor belt 16.

The magnetic separator system 10 also includes at least one, preferably a plurality of magnets, generally indicated at 24, located near the underside of the upper conveyor 14 and extending along a length of the conveyor belt 16. In the embodiment illustrated, the magnets 24 include an oscillating magnet 26 and a stationary discharge magnet 28. The stationary discharge magnet 28 includes at least one, preferably a plurality of magnetic bars 30 extending longitudinally and spaced laterally the width of the conveyor belt 16 before a discharge chute 32 of the frame 20. The magnetic bars 30 are alternated between magnetic poles to create magnetic attraction along the length of the conveyor belt 16. It should be appreciated that the magnetic bars 30 are suitably supported by the frame 20. It should be appreciated that the magnetic bars 30 create a magnetic attraction with the metallic materials that are held against the conveyor belt 16.

The oscillating magnet 26, according to the present invention, includes at least one, preferably a plurality of movable magnetic bars 33 extending longitudinally and spaced laterally. In the embodiment illustrated, the oscillating magnet 26 includes two spaced rows of magnetic bars 33. However, those having ordinary skill in the art will appreciate that there could be any number of rows of magnetic bars 33 including a single row or in more than one row and up to any number of rows of magnetic bars 33. The oscillating magnet 26 includes at least one, preferably a plurality of rotatable rollers 34 that ride along a plurality of guide rails 36 of the frame 20. The guide rails 36 extend laterally across the frame 20 and the rollers 34 ride along a top of the guide rails 36. The oscillating magnet 26 includes at least one, preferably a plurality of rotatable guide rollers 37A that ride along a side of one of the guide rails 26 to keep alignment of the oscillating magnet 26 as it moves. The oscillating magnet 26 also includes a rack and pinion 37B to keep alignment of the oscillating magnet 26 as it moves. It should be appreciated that the rollers 34 carry the magnetic bars 33 back and forth laterally.

The magnetic separator system 10 also includes an oscillator drive system, generally indicated at 38, for moving the oscillating magnet 26 in a reversing motion left and right or laterally back and forth across a width of the conveyor belt 16 of the upper conveyor 14. The oscillating drive system 38 includes an electric motor 40 that drives a rotatable first sprocket 42, chain 44, and second sprocket 46 that is attached by a suitable bearing to an upper end of a rotatable shaft 48 located in the center of the upper conveyor 16 to move the oscillating magnet 26. The oscillating drive system 38 also includes a crank arm 50 having one end that is attached by a suitable bearing to a lower end of the rotatable shaft 48. The oscillating drive system 38 further includes a linear bearing 52 connected by a suitable radial bearing to the other end of the crank arm 50 that rides along a rail 54 of the oscillating magnet 26. As the crank arm 50 is rotated, the linear bearing 52 moves longitudinally along the rail 54 back and forth to move the oscillating magnet 26 laterally back and forth relative to the conveyor belt 16. This oscillating movement causes the materials to travel with the oscillating magnet 26 above the conveyor belt 16 left and right while also travelling down the length of the upper conveyor 14. As the materials follow the oscillating magnet's movement left and right across the conveyor belt 16, the metallic materials flip over and over. It should be appreciated that this flipping action enables the non-metallic materials to become separated or "liberated" from the metallic materials where they then fall down to the lower conveyor 12.

In operation, comingled materials (metallic and non-metallic) to be separated from a product stream enter on the lower conveyor 12 in close proximity to the upper conveyor 14. As the comingled materials (metallic and non-metallic) are conveyed below the entry point of the conveyor belt 16, the magnetic bars 33 of the oscillating magnet 26 capture and transfer the metallic materials and entrapped non-metallic materials to the conveyor belt 16 of the upper conveyor 14. It should be appreciated that the materials remaining on the lower conveyor 12 continue through the process.

As the materials transferred and captured on the upper conveyor 14 continue their travel along the conveyor belt 16, the magnetic bars 33 of the oscillating magnet 26 are moved in a reversing motion left and right across the width of the conveyor belt 16. This movement causes the materials to travel with the moving magnetic bars 33 above the conveyor belt 16 left and right while also travelling down the length of the upper conveyor 14. As the materials follow the movement of the oscillating magnet 26 left and right across the conveyor belt 16, the metallic materials flip over and over. This flipping action enables the non-metallic materials to become separated or "liberated" from the metallic materials where they then fall down to the material product stream of the lower conveyor 12. The separated metallic materials continue to travel across the stationary discharge magnet 28 where they remain on the conveyor belt 16. By the time the separated metallic materials reach the end of the upper conveyor 14, only magnetic metallic materials remain on the conveyor belt 16. The upper conveyor 14 is extended beyond the discharge point of the lower conveyor 12 so that when the metallic materials reaches the end of the conveyor belt 16 and are discharged by gravity, they fall through the discharge chute 32 into a separate collection area from where the materials discharging from the lower conveyor 12 are conveyed for further processing.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A magnetic separator system comprising:

a lower conveyor adapted to convey comingled materials to be separated;

an upper conveyor disposed above said lower conveyor;

at least one magnet extending along a length of said upper conveyor to transfer metallic materials from the comingled materials to said upper conveyor; and an oscillator for moving along said at least one magnet in a reversing motion across a width of said upper conveyor causing the metallic materials to flip over and over and enabling non-metallic materials entrapped with the metallic materials to become separated from the metallic materials and fall to said lower conveyor.

2. A magnetic separator system as set forth in claim 1 wherein said oscillator comprises an oscillating magnet and an oscillator drive system for moving said oscillating magnet in a reversing motion laterally back and forth across the width of said upper conveyor.

3. A magnetic separator system as set forth in claim 2 wherein said oscillating magnet includes a plurality of magnetic bars extending longitudinally and spaced laterally.

4. A magnetic separator system as set forth in claim 3 wherein said oscillating magnet includes at least one row of said magnetic bars.

5. A magnetic separator system as set forth in claim 2 wherein said oscillating drive system includes an electric motor, a rotatable first sprocket driven by said electric motor, a chain cooperating with said first sprocket, a second sprocket cooperating with said chain, and a rotatable shaft connected to said second sprocket.

6. A magnetic separator system as set forth in claim 5 wherein said oscillating drive system includes a crank arm having one end attached to said rotatable shaft.

7. A magnetic separator system as set forth in claim 6 wherein said oscillating drive system includes a linear bearing connected to the other end of said crank arm.

8. A magnetic separator system as set forth in claim 2 wherein said upper conveyor includes a frame having a plurality of guide rails extending laterally thereacross.

9. A magnetic separator system as set forth in claim 8 wherein said oscillating magnet includes a plurality of rotatable rollers that ride along a top of said guide rails.

10. A magnetic separator system as set forth in claim 8 wherein said oscillating magnet includes a plurality of rotatable guide rollers that ride along a side of one of said guide rails to keep alignment thereof.

11. A magnetic separator system as set forth in claim 1 wherein said at least one magnet comprises a stationary discharge magnet.

12. A magnetic separator system as set forth in claim 11 wherein said stationary discharge magnet includes a plurality of magnetic bars extending along the width of said upper conveyor.

13. A magnetic separator system as set forth in claim 12 wherein said magnetic bars are alternated between poles along the length thereof to create magnetic attraction.

14. A magnetic separator system comprising:

a lower conveyor adapted to convey comingled materials to be separated;

an upper conveyor disposed above said lower conveyor and having a frame with a plurality of guide rails extending laterally thereacross;

a stationary discharge magnet extending along a length of said upper conveyor to transfer metallic materials from the comingled materials to said upper conveyor; and an oscillating magnet having a plurality of rotatable rollers that ride along a top of said guide rails and an oscillating drive system for moving said oscillating magnet in a reversing motion across a width of said upper conveyor causing the metallic materials that follow movement of said oscillating magnet to flip over and over and enabling non-metallic materials entrapped with the metallic materials to become separated from the metallic materials and fall to said lower conveyor.

15. A magnetic separator system as set forth in claim 14 wherein said stationary discharge magnet includes a plurality of magnetic bars extending along the width of said upper conveyor.

16. A magnetic separator system as set forth in claim 14 wherein said oscillating magnet includes a plurality of magnetic bars extending longitudinally and spaced laterally.

17. A magnetic separator system as set forth in claim 14 wherein said oscillating magnet includes a plurality of rotatable guide rollers that ride along a side of one of said guide rails to keep alignment thereof.

18. A magnetic separator system as set forth in claim 14 wherein said oscillating drive system includes an electric motor, a rotatable first sprocket driven by said electric motor, a chain cooperating with said first sprocket, a second sprocket cooperating with said chain, and a rotatable shaft connected to said second sprocket.

19. A magnetic separator system as set forth in claim 18 wherein said oscillating drive system includes a crank arm having one end attached to said rotatable shaft and a linear bearing connected to the other end of said crank arm.

20. A magnetic separator system comprising:

a lower conveyor adapted to convey comingled materials to be separated;

an upper conveyor disposed above said lower conveyor and having a frame with a plurality of guide rails extending laterally thereacross;

a stationary discharge magnet having a plurality of magnetic bars extending along a width of said upper conveyor to transfer metallic materials from the comingled materials to said upper conveyor;

an oscillating magnet having a plurality of magnetic bars extending longitudinally and spaced laterally and a plurality of rotatable rollers that ride along a top of said guide rails; and an oscillating drive system including an electric motor, a rotatable first sprocket driven by said electric motor, a chain cooperating with said first sprocket, a second sprocket cooperating with said chain, and a rotatable shaft connected to said second sprocket for moving said oscillating magnet in a reversing motion across a width of said upper conveyor causing the metallic materials that follow movement of said oscillating magnet to flip over and over and enabling non-metallic materials entrapped with the metallic materials to become separated from the metallic materials and fall to said lower conveyor.

* * * * *